US006750778B1

(12) United States Patent
Chen

(10) Patent No.: US 6,750,778 B1
(45) Date of Patent: Jun. 15, 2004

(54) THERMAL SENSING ALARM STRUCTURE

(76) Inventor: Yi-Chen Chen, No. 68-31, Yan Ji St., Da An Area, Taipei (TW)

( * ) Notice: Subject to any disclaimer, the term of this patent is extended or adjusted under 35 U.S.C. 154(b) by 0 days.

(21) Appl. No.: 10/327,966

(22) Filed: Dec. 26, 2002

(51) Int. Cl.[7] ..... G08B 23/00
(52) U.S. Cl. ..... 340/693.5; 340/567; 361/752
(58) Field of Search ..... 340/693.5, 567, 340/565, 693.7, 693.9, 693.6, 545.3, 552–557; 361/752, 758, 760, 679, 736, 748, 761, 829, 756

(56) References Cited

U.S. PATENT DOCUMENTS 4,873,469 A * 10/1989 Young et al. ..... 315/155
5,790,040 A * 8/1998 Kreier et al. ..... 340/693.1
6,369,688 B1 * 4/2002 Abe et al. ..... 337/299
6,428,350 B1 * 8/2002 Robinson et al. ..... 439/517

* cited by examiner

*Primary Examiner*—Daniel J. Wu
*Assistant Examiner*—Sihong Huang
(74) *Attorney, Agent, or Firm*—Birch, Stewart, Kolasch & Birch, LLP

(57) ABSTRACT

An improved thermal sensing alarm structure comprises a closed chassis having an upper casing with a Fresnel lens and a lower casing; a circuit board between the upper and lower casings; a plurality of wedges protruded from both inner lateral sides of the upper casing such that the upper and lower casing being latched by the latching grooves and wedges; a DC power socket, a long pin terminal, and battery power supply wire being soldered on the circuit board; at least one embedding groove with appropriate width and a set of terminal slot being disposed at an end of the lower casing, such that the circuit board can be inserted into the embedding groove and terminal slot and fixed by the DC power socket and long pin terminal.

4 Claims, 6 Drawing Sheets

PRIOR ART

THERMAL SENSING ALARM STRUCTURE

BACKGROUND OF THE INVENTION

1. Field of the Invention

The present invention relates to an improved thermal sensing alarm structure, more particularly to a thermal sensing alarm with a lower casing having an embedding groove and terminal socket for accommodating the insertion of the power socket and long pin terminal on the circuit board to attain a very excellent fixing effect, and requires no traditional screw-and-nut connection and multiple soldering, but just needs to press down the circuit board for the assembling, and thus the present invention features the cost reduction.

2. Description of the Related Art

Traditional thermal sensing alarm structure generally includes the following features: a Fresnel lens provides a window for focusing the infrared ray of the human radiation; a sliding switch for the functional selection; a loudspeaker window for providing an outlet of alarm sound; and a battery compartment or DC power socket.

However, the detection is affected by the focal distance of the Fresnel lens and the size, position, and direction of mirror window, which makes the manufacture of the alarm with the aforementioned features very difficult and has the shortcomings of the high cost.

Please refer to FIG. 5. A close chassis is composed of an upper casing 60 with a Fresnel lens and a lower casing 70, and a circuit board 80 is disposed between the upper casing 60 and the lower casing 70; wherein the lower casing 60 has a screw post 61 each on both ends of the upper casing 60, a latching groove on both inner lateral sides each, a tubular post 71 disposed on each end of the upper casing 60, a wedge protruded on each lateral side, and a battery compartment 73 disposed at the lower section of the lower casing 70 and covered by a cover 74; the upper case 60 and a lower case 70 having a half axle base 63, 75 disposed at an appropriate position; and the two combine to form an axle for pivotally coupling to the base 76.

Before a circuit board 80 containing the components of the alarm system is coupled to the upper casing 60 and the lower casing 70, the battery button 100 of the power wire 101 should pass through the wire hole 77 of the lower casing 70, and the battery button 100 of the power wire 101 is soldered to the terminal of the externally connected DC power socket on the circuit board and two short screws 803 secure the DC power socket to the fixing post 78 of the lower case 70.

The circuit board 80 form a concave opening 81 each on both ends; when the circuit board 80 is placed on the lower casing 70, the two concave openings 81 exactly align with the inner margin of the tubular post 71, while the upper casing and the lower casing align with each other, not only snapped with each other by the embedding section 62 and the wedge 72, the screw post 61 also aligns with the tubular post 71 and the battery compartment 73 on the lower casing 70 having two screws 90 passing through the tubular post 71 of the lower casing 70, and being secured on the screw post 61 of the upper casing. The battery compartment 73 is covered by the close cover 74 such that the upper casing and the lower casing can hold the circuit board 80 in position for the assembling. A U-shape base 76 and axle base 63, 75 are pressed and pivotally coupled to constitute the complete structure.

However, the prior art structure described above does not have a good design, therefore the following shortcomings are found in the practice:

1. The prior-art power wire of the circuit board and the battery button wire soldered to the DC socket terminal is a secondary manufacturing process, and the power wire of the battery button must be passed through the wire hole of the lower casing, before the power wire is soldered onto the DC socket terminal. The complicated manufacturing process and the increase in cost are the shortcomings of the prior art.
2. When the upper casing and lower casing are assembled, the two small screws on the DC socket should be secured on the short posts of the lower casing, and the circuit board is placed on the lower casing, and the loudspeaker is attached on the isolating wall of the lower casing. After the upper casing and the lower casing are combined, the screws are passed through the bottom of the battery compartment for the fixing. Such two steps of fixing by screws increase the cost, and the operating procedure is complicated, which is another main shortcoming of the prior art.

SUMMARY OF THE INVENTION

The primary objective of the present invention is to design a screwless structure under the common requirements for the general thermal sensing alarm having a Fresnel lens, a sliding switch, a loudspeaker window, a battery compartment, or a DC power wire socket, which does not require a secondary terminal soldering manufacturing procedure, particularly the space restricted by the focal distance of the Fresnel lens affecting the general features of the thermal sensing alarm structure can be fully overcome. A refined, compact structure with simple manufacturing procedure can be accomplished. The assembling and manufacturing only require to pass the terminal of the battery button through the wire hole of the lower casing, and the DC power socket and long pin terminal on the circuit board are pressed and inserted into the embedded groove in the lower casing, and then the loudspeaker is attached on the wall in the lower casing. Then, the upper casing and the lower casing are pressed together, and a U-shape base and axle base are pressed and pivotally coupled to complete the combination. Such a simple manufacturing process gives an excellent fixing effect, and abandons the prior-art screw fixing procedure, which simplifies the manufacturing procedures and lowers the cost. The maintenance of the alarm according to the present invention is very convenient and thus can lower the cost.

To accomplish the foregoing objectives, the present invention uses the following method:

An upper casing and a lower casing constitute a close chassis, and a circuit board is fixed between the upper casing and the lower casing; wherein the upper casing at its appropriate position having a Fresnel lens; the lower casing at its bottom having a battery compartment, which is covered by a close cover; wherein the end of the lower casing at least having an embedding groove with appropriate width and a set of terminal slot; the power socket and the long pin terminal of the circuit board are soldered directly to lower section of the circuit board and exactly aligned with the embedding groove and the terminal slot, such that when the circuit board is pressed into the terminal slot, the fixing is done simultaneously. It does not only attain a good fixing effect, but also can save the trouble of fixing screws as done in the prior art, and make the assembling and maintenance very convenient.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
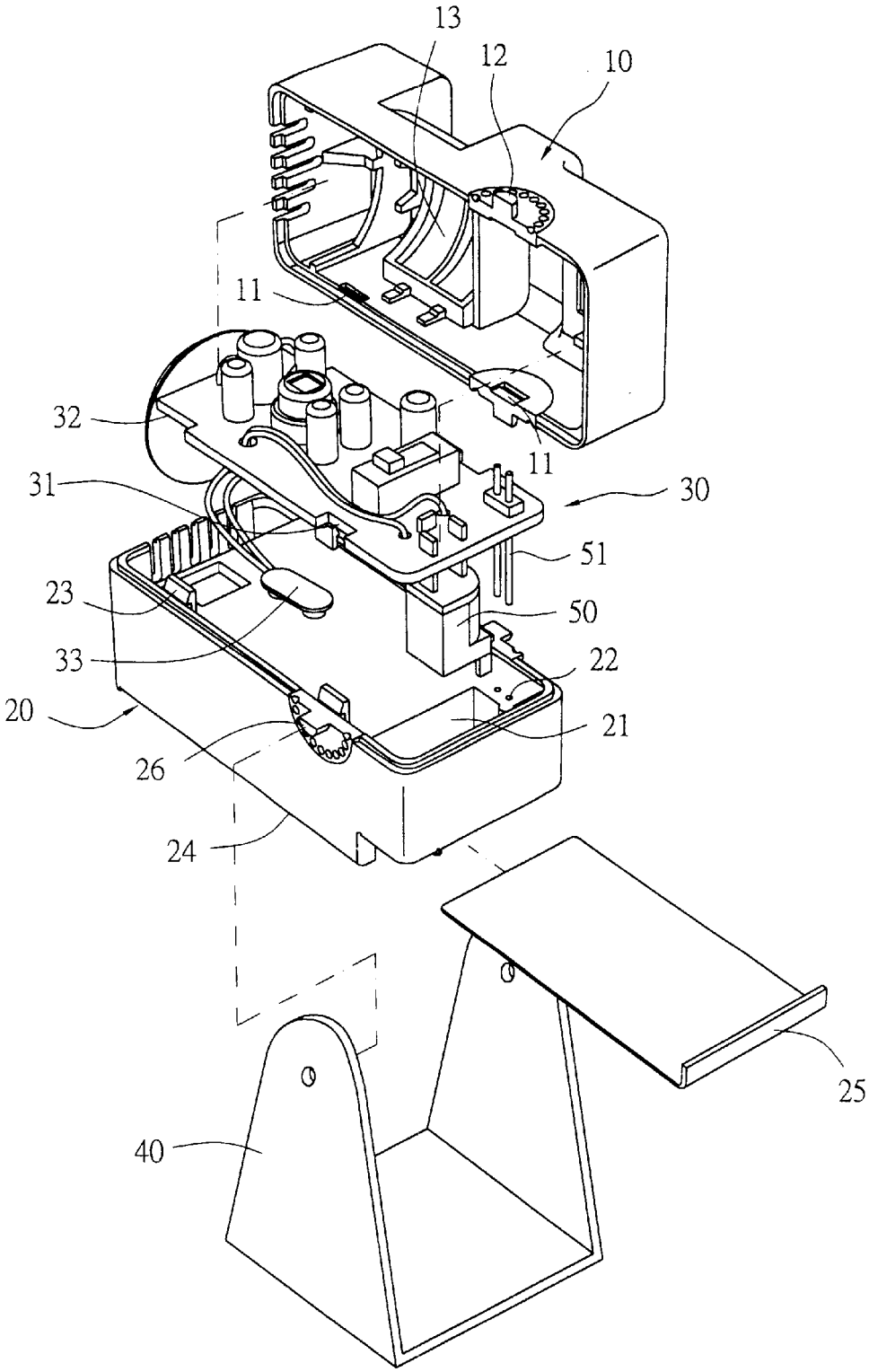
FIG. 1 is a diagram showing the disassembled structure of the present invention.

In the detailed description of the preferred embodiments, it should be noted that like elements are indicated by the same reference numerals throughout the disclosure.

Figure 2:
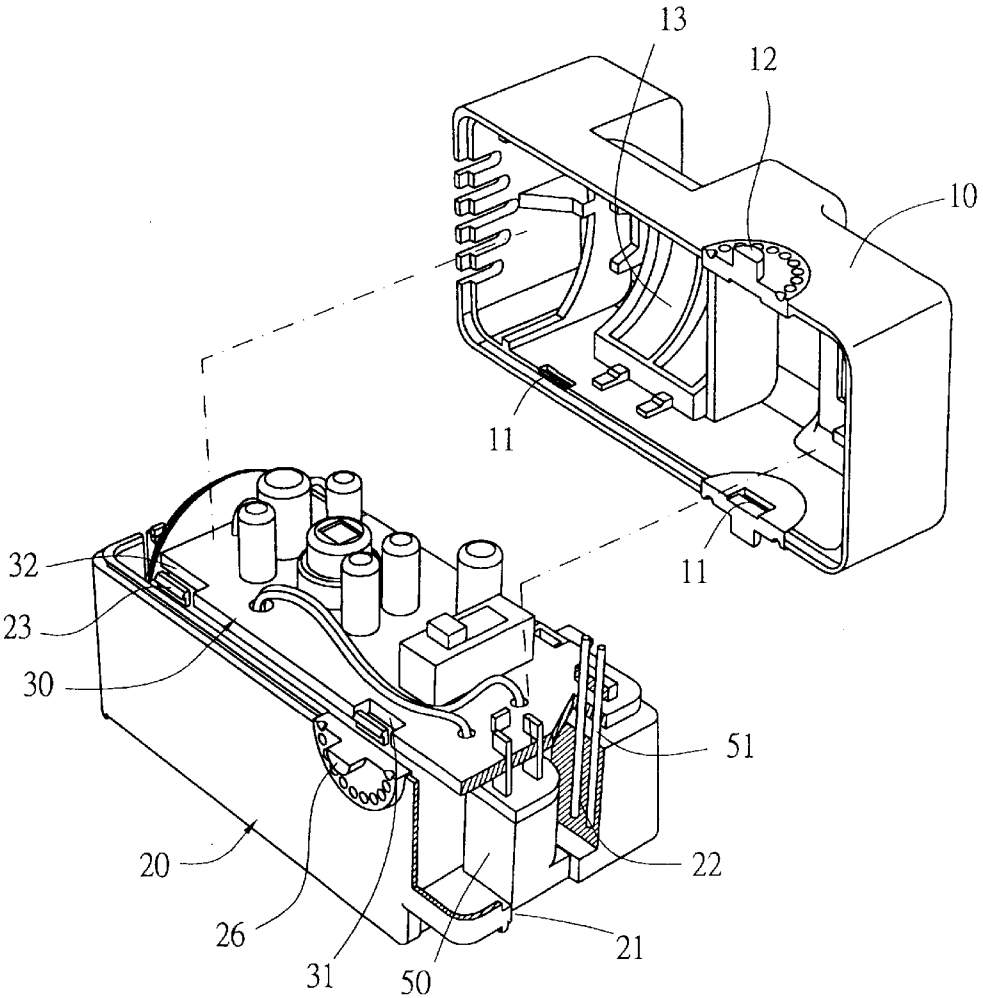
FIG. 2 is a cross-sectional diagram of some part of the assembly of the present invention.
Figure 3:
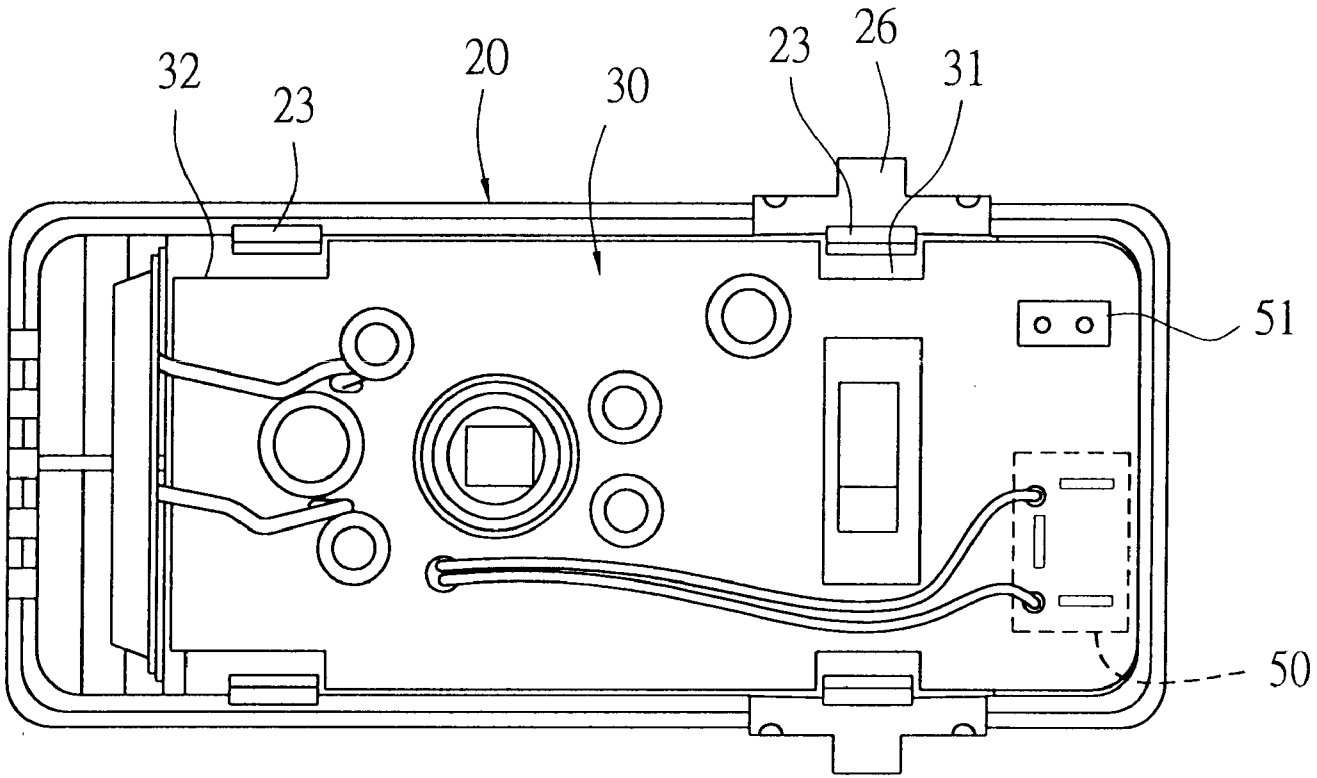
FIG. 3 is a down view diagram of the structure of the present invention.

Please refer to FIG. 1, FIG. 2, and FIG. 3. The present invention comprises a close chassis composing an upper casing 10 and a lower casing 20, a circuit board 30 disposed between the upper casing 10 and the lower casing 20; wherein the upper casing 10 at its central position having a Fresnel lens 13, and a plurality of latching grooves 11 on both inner sides of the upper casing 10; a pair of axle bases 12 protruded from an appropriate position on the outside.

The lower casing 20 comprises a battery compartment 24 disposed on the bottom and covered by a close cover 25; a axle base 26 disposed each on both sides of lower casing 20 such that when the upper casing 10 and the lower casing 20 are latched, the two axle bases 12, 26 are also aligned for the pressing and pivotal coupling of both sides by a U-shape base 40.

Please refer to FIG. 1, FIG. 2, and FIG. 3. The lower casing 20 at one of its ends has at least an embedded groove 21 with an appropriate width and a set of terminal slot 22; a plurality of wedges 23 protruded from two inner side such that the wedges 23 is latched to the latching groove 11 of the upper casing 10.

Figure 4:
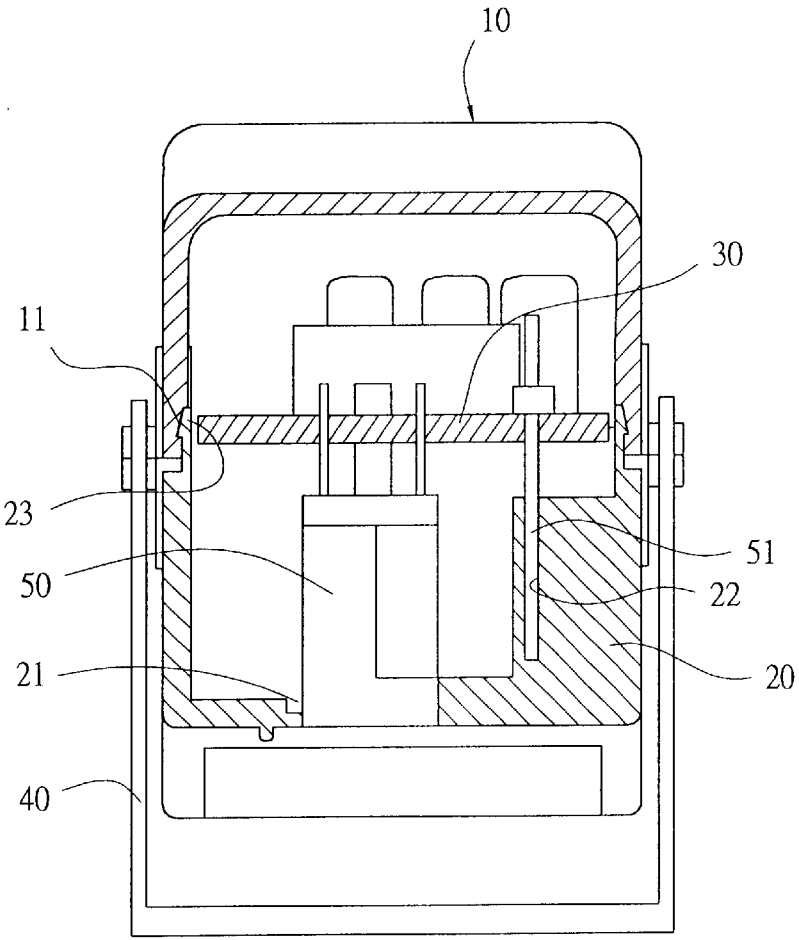
FIG. 4 is a cross-sectional diagram of the present invention.
Figure 5:
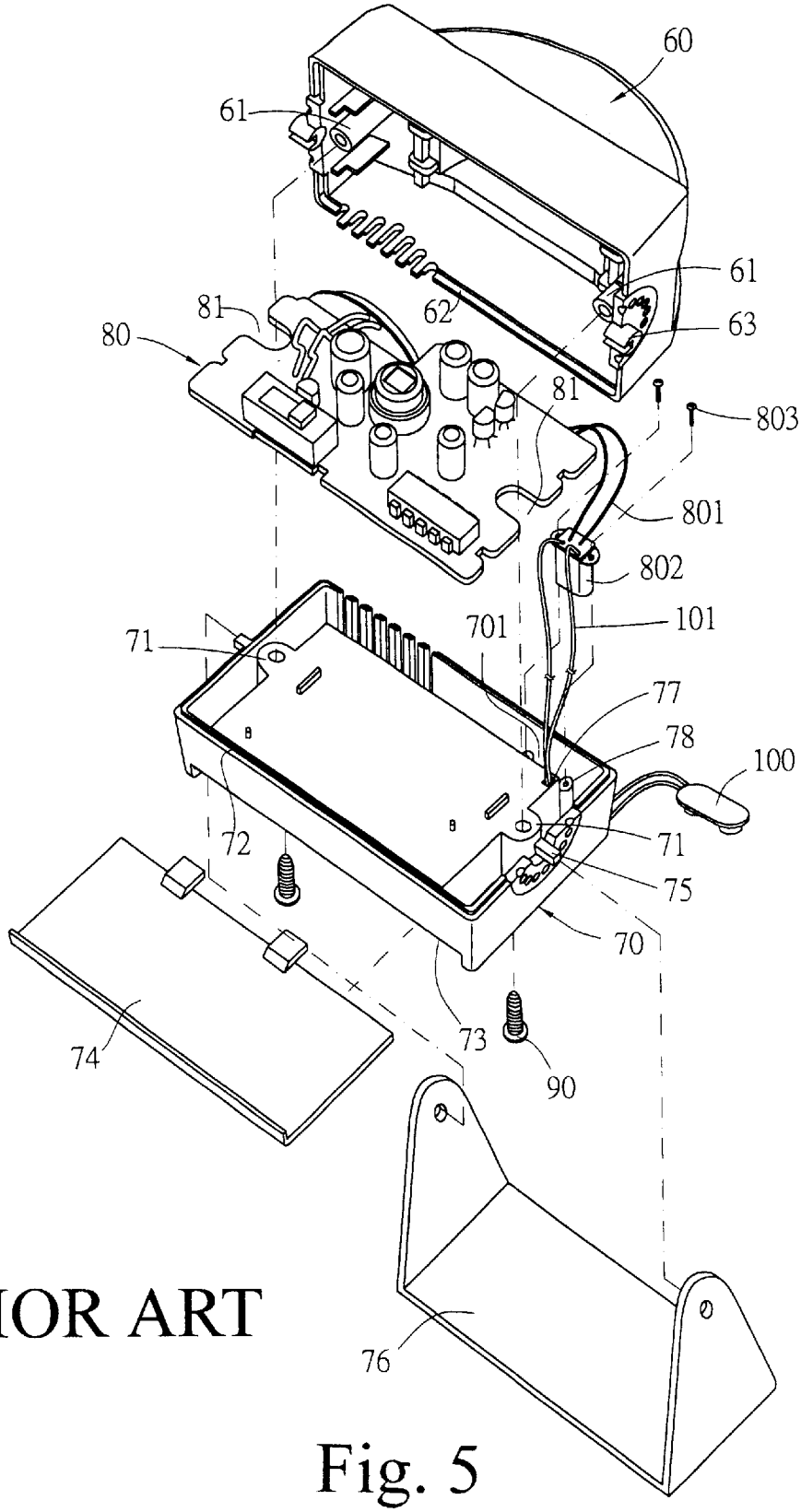
PRIOR ART Fig. 5
FIG. 5 is a diagram of the prior art structure.
Figure 6:
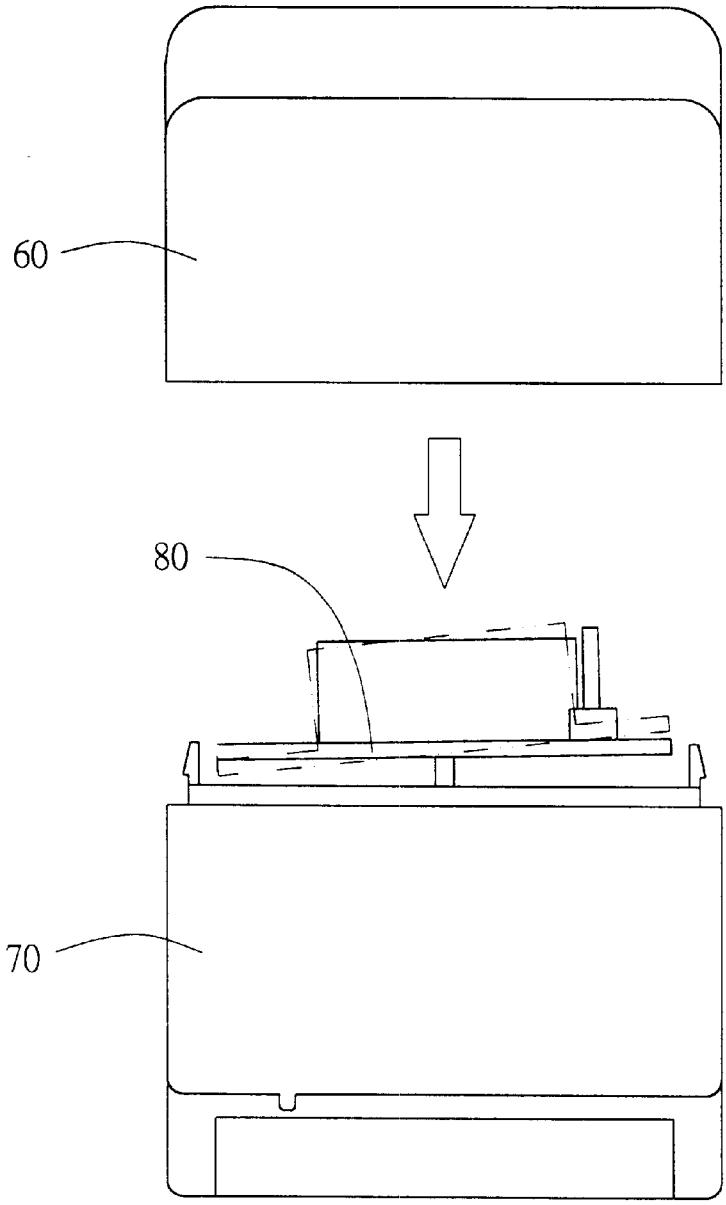
FIG. 6 is an illustrative diagram showing the tilted circuit board during the prior-art assembling.

A circuit board 30 has a plurality of indents 31, 32 at the appropriate position; wherein the electronic component of the alarm system on the circuit board 30 directly fixes the DC power socket 50 at the lower section of the circuit board 30, and exactly aligns with the embedding groove 22 of the lower casing 20, and the long pin terminal 51 exactly aligns with the terminal slot 22; when the circuit board 30 is placed on the lower casing 20 and slightly pressed down as shown in FIG. 1, FIG. 2, and FIG. 4, so that the power socket 50 is exactly pressed into the embedding groove 21. In the meantime, the long pin terminal 51 can be inserted and fixed into the terminal slot 22 accordingly. In the meantime, the plurality of indents 31, 32 are latched individually to the wedges so that they will not rotate easily, and also protect the electronic components from being switched. The position of the circuit board 30 is not necessary to be fixed. The assembling of upper casing 10 and the lower casing 20 is not only very fast, the position of the infrared component is very appropriate, so the Fresnel mirror 13 can accomplish the best alarming effect.

Since the present invention is very creative, therefore its application has the following advantages:

1. Since the design of the present invention can directly solder the power socket to the lower end of the circuit board, and the long pin terminal can be inserted into the embedding groove and the terminal slot individually on the lower casing, which can give an excellent tightness and fixing effect. It only needs to slightly press the circuit board downward and makes the assembling very simple without using tools, and also save the trouble of fixing by screws, and also save the cost of the screw component. These are the advantages of the present invention.
2. From the description above, since the position of the circuit board is fixed accurately. It does not only make the assembling of the upper casing and the lower casing very convenient and quick and the position of the infrared component is very appropriate, it can also accurately work with the Fresnel lens 13 to obtain the best alarm effect.
3. From the description above, since the circuit board can be secured very easily for the assembly, the upper casing and the lower casing can use the latching groove and the wedges for the coupling. It also makes the assembly very quick, which is also another advantage of the present invention.
4. If the circuit board of the present invention is damaged and requires replacement or maintenance, we just need to pull the circuit board upward for the removal. It is very convenient and easy for the maintenance or replacement, therefore the present invention can save the trouble of pulling up the cover, removing the battery, and using tools to unscrew the screws to remove the circuit board as done for the prior art design.
5. The upper casing and chassis of the present invention overcome the shortcoming of the prior art that requires the screw posts and tubular posts for the structure by using an embedding groove and terminal slot instead. The manufacturing of the present invention is very simple, and its weight can be reduced. These are also the advantages of the present invention.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. An improved thermal sensing alarm structure, comprising: a close chassis, composing of an upper casing and a lower casing; a circuit board, disposed between the upper casing and the lower casing; wherein said upper casing at its appropriate position having a Fresnel lens; a battery compartment disposed at the bottom of the lower casing and covered by a closed cover; characterized in that: the lower casing at least having an embedding groove with appropriate width at an end of the lower casing, and a power socket of the circuit board being directly soldered at the lower section of the circuit board, and exactly aligning with the embedding groove of the lower casing; such that the power socket exactly pressing into the embedding groove to give a circuit board with excellent stability.

2. An improved thermal sensing alarm structure as claimed in claim 1, wherein said upper casing and lower casing being latched by the latching grooves and the wedges.

3. An improved thermal sensing alarm structure as claimed in claim 1, wherein said upper casing and lower casing having an axle base produced at the outside of both sides such that after the tow are coupled, the axle base being latched into both sides of a U-shape base and pivotally coupled to the base.

4. An improved thermal sensing alarm structure as claimed in claim 1, wherein said lower casing having a set of terminal slot at the end of the lower casing; the circuit board at relative position having a long pin terminal such that the long pin terminal being inserted and fixed in the terminal slot to assist the stability of the circuit board.

* * * * *